United States Patent [19]

Smith

[11] Patent Number: 4,685,154

[45] Date of Patent: Aug. 11, 1987

[54] APRON AND INFANT TOWEL

[76] Inventor: Lynn T. Smith, 1128 Jeffrey Ct., Northbrook, Ill. 60062

[21] Appl. No.: 63,844

[22] Filed: Aug. 6, 1979

[51] Int. Cl.[4] ..... A41B 13/10

[52] U.S. Cl. ..... 2/48

[58] Field of Search ..... 2/48, 69, 74, 84, 73, 2/49 R; D2/265, 226

[56] References Cited

U.S. PATENT DOCUMENTS

| | | | |
|---|---|---|---|
| 1,432,249 | 10/1922 | Hoyme | 2/67 X |
| 2,620,476 | 12/1952 | Kelsall | 2/48 |
| 2,706,817 | 4/1955 | Schneider | 2/84 |
| 2,879,514 | 3/1959 | Shapiro | 2/69 |
| 3,079,611 | 3/1963 | Boryszewski | 2/69 |

*Primary Examiner*—Doris L. Troutman

[57] ABSTRACT

An infant towel and particularly a method for its use beginning with it being worn by the adult user and ending with it being completely wrapped around the infant. This apron-towel has substantially identical front and rear rectangular absorbant panels. These panels are interconnected with spaced shoulder straps that are each readily detachable at the shoulders.

In use, the infant is placed in the front panel, dried, and then the back panel is brought directly over the user's head to encapsulate and assist in drying the infant. By detaching one of the shoulder straps, the back panel can alternatively be brought to the front by bringing it around the side instead of over the head.

4 Claims, 5 Drawing Figures

APRON AND INFANT TOWEL

BACKGROUND OF THE INVENTION

Many aprons and infant towels have been devised in the past but they have not gained significant commercial success for a variety of reaons including cost of manufacture and difficulty of use as well as cleaning problems. Of course, connventional rectangular towels are widely used to dry infants and have been found to satisfactory in most instances. However, many women find it desireable to have an infant towel that is easier to use and performs better than the simple rectangular towel. One such towel consists of a large rectangular panel with a loop strap that fits around the adult's head. This arrangement is an improvement over the simple separate towel in that the user does not have to hold the towel initially while handling the baby and it also keeps the towel in a readily useable orientation. The disadvantage in this prior towel is that to provide an increase in the toweling area it is necessary that the towel hang down too far, perhaps almost to the user's feet.

It is a primary object of the present invention to ameliorate these problems in the prior art of infant towels.

SUMMARY OF THE PRESENT INVENTION

According to the present invention, an apron and infant towel and particularly method for its use are provided that give greatly increased toweling area with simplicity of manipulation in use. The towel itself consists of substantially identical front and rear terrry-cloth panels, generally rectangular. These panels are interconnected by two spaced readily detachable shoulder straps. The straps may be fastened by a variety of releaseable fasteners including buttons, but releaseable material, such as "Velcro" is preferred. In use, the infant is placed on or in the front panel and dried, and thereaafter the user brings the back panel directly over their head and into contact with the infant to assist in toweling. By using the present apron-towel in this fashion, the toweling area is effectively doubled without the inconvenience of holding and using a single large toweling panel.

The releaseable shoulder straps permit an alternative use of the back panel. By releasing only one of the shoulder straps, the back panel will fall to one side under the force of gravity, and the user can then easily bring it around the side to the front and into drying contact with the infant.

DETAILED DESCRIPTION OF THE PREFERRED EMBODIMENT

Figure 1:
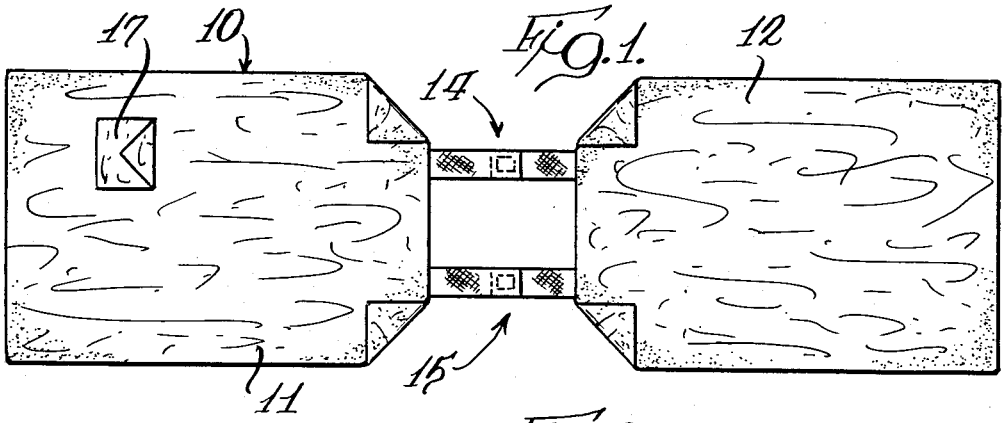
FIG. 1 is a plan view of the present apron and infant towel.
Figure 2:
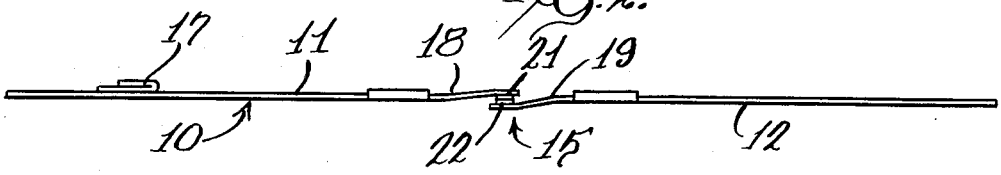
FIG. 2 is a side view of the apron and infant towel shown in FIG. 1.

Viewing the drawings, and particularly FIGS. 1 and 2, the present apron and infant towel, designated generally by the reference numeral 10, is seen to consist of a rectangular terry-cloth front panel 11 and a rectangular terry-cloth back or rear panel 12, interconnected by parallel spaced shoulder straps 14 and 15.

The front and rear panels 11 and 12 have a length sufficient to extend from above the top sternum to the knees of the average American adult woman. Pockets are provided on the outside of the front panel 11, such as shown at 17.

The straps 14 and 15 are spaced from one another so that they may easily fit over the average adult woman's head and rest on her shoulders. An important aspect of the present invention is that the straps 14 and 15 have a sufficient length so that the back panel 12 may be easily brought over the user's head from the back to the front as seen in FIG. 4.

As seen in FIG. 2, each of the shoulder straps 14 and 15 includes a cloth strap 18 fixed at one end to the front panel 11 and a similar cloth strap 19 fixed at one end to the back panel 12. The straps 18 and 19 carry at their ends readily releaseable material fastener pads 21 and 22, such as "Velcro" pads, to permit the straps 14 and 15 to be detached selectively at the user's shoulders.

Figure 3:
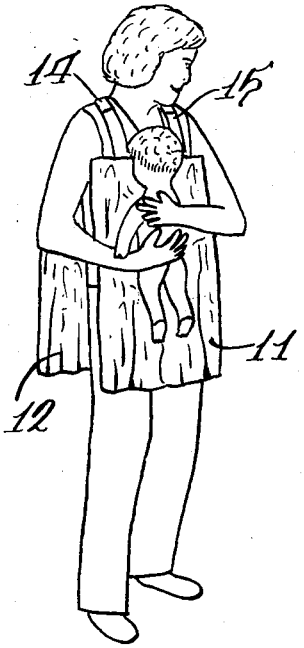
FIG. 3 is a perspective view of the apron and infant towel on an adult user.
Figure 4:
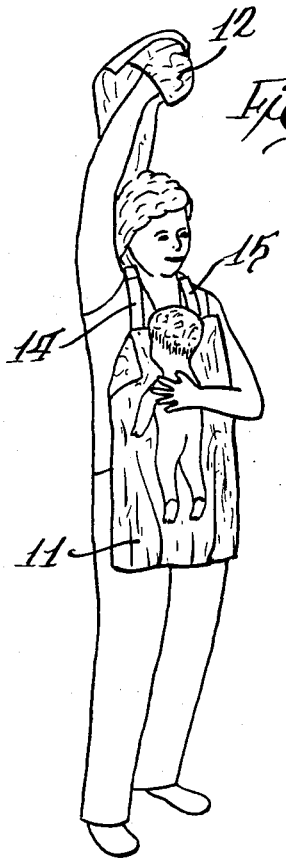
FIG. 4 is a perspective view of the apron and infant towel on an adult user as the back panel is being brought over the adult's head.

As seen in FIGS. 3 and 4, the apron and infant towel 10 is used by initially wearing it in apron fashion as seen in FIG. 3 with the front panel 11 on the user's front and the back panel 12 on the user's back with the shoulder straps 14 and 15 engageing the shoulders. The infant is then placed on the front panel 11 after bathing.

The back panel 12 is then easily used to assist in drying the baby simultaneously with the front panel 11 by drawing it with one hand directly over the head as seen in FIG. 4 and into drying engagement with the infant in the front, and where both front and back panels 11 and 12 encompass the infant.

Figure 5:
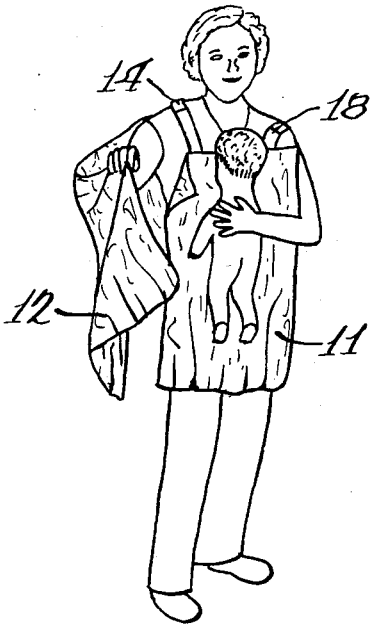
FIG. 5 is a perspective view of the apron and infant towel on an adult user as the back panel is being brought around the side.

The back panel 12 also may be easily brought around to the front by releasing one of the shoulder straps 14 or 15 as seen in FIG. 5. The back panel 12 will then fall to one side of the user, where it is then brought around to the front easily with one had.

I claim:

1. A method of toweling an infant or other objects to be dried with a towel having front and back panels connected by shoulder straps, including the steps of: placing the towel on the human user with the front panel on the user's front and the back panel on the user's back, with the shoulder straps across the user's shoulders, placing the object to be dried on the front panel, and bringing the back panel over the user's head and into engagement with the object and the front panel so that both front and back panels are utilized to dry the object.

2. The method of toweling an infant or other objects to be dried as defined in claim 1, and further including the alternative step of detaching one of the shoulder straps and bringing the back panel around the user's side and into engagement with the object and the front panel so that both front and back panels are utilized to dry the object.

3. A method of toweling an infant or other objects to be dried with a towel having front and back panels connected by two spaced readily detachable shoulder straps, including the steps of: placing the towel on the human user with the front panel on the user's front and the back panel on the user's back, with the shoulder straps across the user's shoulders, placing the object to be dried on the front panel, detaching only one of the shoulder straps permitting the back panel to fall to one side, and bringing the back panel around the user's side and into engagement with the object and the front panel so that both front and back panels are effective in drying the object.

4. A method of toweling a infant or other objects to be dried with a towel having front and back panels connected by shoulder straps, including the steps of: placing the towel on the human user with the front panel on the user's front and the back panel on the user's back with the shoulder straps accross the user's shoulders, placing the object to be dried on the front panel, bringing the back panel over the user's head and into engagement with the object and the front panel so that both the front and back panels are utilized to dry the object, and alternatively with the towel on the human under detaching one of the shoulder straps and bringing the back panel around the user's side and into engagement with the object and the front panel so that both the front and back panels are employed to dry the object.

* * * * *

UNITED STATES PATENT AND TRADEMARK OFFICE

CERTIFICATE OF CORRECTION

PATENT NO. : 4,685,154

DATED : August 11, 1987

INVENTOR(S) : Lynn T. Barras

It is certified that error appears in the above-identified patent and that said Letters Patent is hereby corrected as shown below:

On The Title Page Item [19] should read -- Barras --.

Item [76] should read -- Lynn T. Barras --.

Signed and Sealed this

Nineteenth Day of January, 1988

*Attest:*

DONALD J. QUIGG

*Attesting Officer*

*Commissioner of Patents and Trademarks*